United States Patent [19]

Andoniev et al.

[11] 4,132,852

[45] Jan. 2, 1979

[54] COOLED ROOF OF ELECTRIC FURNACE

[76] Inventors: Sergei M. Andoniev, prospekt Pravdy, 5, Kv. 60; Lev D. Gritsuk, ulitsa Kombainovskaya, 13, Kv. 3; Anatoly S. Gorbik, prospekt Lenina, 24, Kv. 31, all of Kharkov; Viktor V. Kurganov, ulitsa 40 let Sovetskoi Ukrainy, 11, Kv. 5, Zaporozhie; Nikolai P. Oleinik, ulitsa Matrosova, 6a, Kv. 58; Grigory I. Rivlin, ulitsa Krasnoznamennaya, 7/9, Kv. 79, both of Kharkov; Nikolai V. Stetsenko, ulitsa Patrioticheskaya, 32, Kv. 34, Zaporozhie; Jury P. Shamil, prospekt Lenina, 232, Kv. 47, Zaporozhie; Jury G. Smetanin, bulvar Gvardeisky, 136a, Kv. 11, Zaporozhie; Petr S. Nesterenko, ulitsa Mayakovskogo, 3, Kv. 15, Zaporozhie, all of U.S.S.R.

[21] Appl. No.: 861,503

[22] Filed: Dec. 16, 1977

[51] Int. Cl.[2] ..... F27D 1/02; F27D 1/12

[52] U.S. Cl. ..... 13/32; 110/331; 266/241; 432/238

[58] Field of Search ..... 13/32, 35; 110/331; 266/241; 432/237, 238

[56] References Cited

U.S. PATENT DOCUMENTS

| | | | |
|---|---|---|---|
| 2,766,736 | 10/1956 | Del-Buono | 13/32 X |
| 3,429,973 | 2/1969 | Carter et al. | 13/32 X |
| 3,967,048 | 6/1976 | Longenecker | 13/32 X |
| 4,003,696 | 1/1977 | Rolla | 432/238 |

*Primary Examiner*—R. N. Envall, Jr.
*Attorney, Agent, or Firm*—Haseltine, Lake, & Waters

[57] ABSTRACT

A roof in which beams-headers rest on a roof ring and carry loop-shaped tubes suspended from and coupled with the said beams-headers which are running transversely to the framework tubes. Welded edgewisely to the top generatrices of the tubes are metal straps with bricks placed at least in one layer in rows therebetween. The brick end portions rest on the adjacent tubes, so that the brick in each row are disposed with a clearance sufficient to enable thermal expansion of the brick both vertically and horizontally when heated.

1 Claim, 3 Drawing Figures

COOLED ROOF OF ELECTRIC FURNACE

BACKGROUND OF THE INVENTION

The present invention relates to cooled roofs for electric furnaces.

One of the major trends in present-day electric steel-melting practice is continuous enhancement of both the capacity and specific power of arc steel-making furnaces. Recent years mark the construction of large-capacity electric furnaces which along with converters are considered to be promising in terms of their future development as compared with all other metallurgical units.

Intensification of electric steel-melting production by using gaseous oxygen and higher-rating transformers for melting steels of various chemical composition has, to a considerable extent, deteriorated the operating conditions of the refractory brickwork in electric-arc steel-making furnaces.

The roofs of the electric-arc furnaces are operating under especially severe conditions, being exposed to the combined effect of extremely high temperatures and variable thermal loads, on one hand, and heat products and reducing furnace atmospheres, on the other. All these factors are responsible for reduced strength of the roof brickwork, more irregular wear of roof brick, brickwork deformation and early stoppage of the furnaces, inspite of considerable remaining thickness of their lining, which results in a higher consumption of expensive refractory materials.

Moreover, the present-art roofs of the electric steel-making furnaces are designed so that there is always a danger of the brickwork disruption even before the beginning of operation of the roof, since the brick are wedged to such an extent as to preclude their falling out. Thus, when the furnace roof is erected and then brought into operation, i.e. undergoing heating to a temperature of 1700° to 1800° C., the refractory brick is able neither to elongate nor to expand; its absolute elongation and expansion characteristics in the above temperature range are quite substantial. This gives rise to thermomechanical stresses originating in the roof brickwork, that cause cracking, which, in the case of recurrent heating and cooling cycles, is liable to develop with the ensuring spalling of the refractory lining on the electric furnace roof. Therefore, attempts were made to compensate for the stresses arising in the brickwork in the course of operation of a furnace roof by placing burning-out strips in the roof or using various mortars for laying roof brickwork. It did not, however, produce the desired effect and the life period of furnace roofs extended almost negligibly.

The term of life of the electric furnace roofs was extended by constantly improving the quality of used refractories and developing new kinds of refractory materials and bricks.

However, this trend is inefficient, because the cost of refractories grow constantly and practically out of proportion to the extension of the life period of electric furnace roofs, — a feature that should not be overlocked.

An alternative that was selected in this search of possiblities and means for extending the life period of the roofs of electric furnaces lay in developing cooled structures.

DESCRIPTION OF THE PRIOR ART

There is known a tubular cooled roof using a high-alumina refractory composition as a lining. The roof employed evaporative cooling. In other words, it utilized the heat absorbed by a heat carrier. However an increase in electric power requirements per unit product has rendered the roof inefficient.

In some cases roofs are placed on an automatically controlled heater prior to putting them in operation, or various cooled pieces are placed in a roof brickwork.

Yet they happened to be inefficient as well, and did not allow extending appreciably the life period of electric furnace roofs.

There was developed an ore-roasting furnace with tubes arranged on close centers and supporting a heat-insulating material. In this case a metallurgical unit was turned into a steam generator which lead to a sharp increase in power consumption in view of an immense area of cooled surface, insofar as the entire furnace roof and walls were practically made up of cooled tubes.

Inventor's Certificate of the USSR No. 214560 discloses a roof for an electric-arc steel-making furnace. This roof is provided with a water cooling system and a lining of a refactory composition. With a view to extending the life period of the roof, the lining is attached to a cooled screen comprising radial tubes to which a highly-refractory material is applied, the bottom ends of said tubes being coupled with a header and the top ones with a flat box in the central part of the roof. To facilitate erection, the roof is made of a plurality of interchangeable interconnected sections.

This roof had a long life period. The excessive consumption of electric power varying, however, in the range between 10 and 12%, diminished materially its economic efficiency.

Moreover, it was necessary to reweld steel fins supporting the refractory composition.

Also known in the art are roofs for electric steel-making furnaces. These roofs, for the purpose of extending their life period, are made combined, i.e. with a water cooling system and a lining shaped as a metal hood having a cover with electrode holes, and double walls forming a space therebetween for the passage of running water which acts as a roof coolant. Welded around the circumference of the bottom wall on the side facing the furnace working space, are radial ribs forming a honeycomb structure filled with a refractory composition. Along with a sophisticated framework, complicated in manufacture, and a need for rewelding the ribs, this roof suffers from a commonly known disadvantage, i.e. higher power requirements per unit product.

U.S. Pat. No. 3053237 teaches a hood lining for an electric-arc melting furnace, comprising cooling tubes and studs secured thereto and extending into a refractory layer, which ensures both the cooling and mechanical attachment of the refractory layer. But, characteristic of this roof are excessive heat losses that are responsible for high power inputs, a feature which negates a major advantage of the roof, i.e. its extended life period.

Other roofs of a similar construction also fail to solve the problem of extending their service life.

Analyzing the design of the prior-art cooled roofs developed in different countries, it is worth noting that the problem of extending the service life of electric furnace roofs has not yet been solved. The major difficulty to cope with lies in highly complicated fabrication of roof metal structures, insofar as the linking of tubular members, especially of box-shaped structures, calls for precision-shaped components. This complicates their abutting and renders all operations involved in producing metal roof framework extemely labor-consuming. Moreover, all members of the roof metal structures being rigidly interconnected, on high-temperature heating they are subject to the effect of stresses transmitted to the roof lining, which is liable to spall off and fall out when using a refractory composition.

SUMMARY OF THE INVENTION

The main object of the present invention is to provide a cooled roof for an electric furnace, featuring a more extended period of life than the prior-art roofs of similar application, and minimum heat losses.

Another no less important object of the invention is to provide a roof simple in design, particularly from the standpoint of erecting the roof proper and its lining.

Still another object of the invention is the provision of a cooled roof which will allow replacing a worn-out lining thereof in any section of said roof without removing it from the furnace.

Yet another important object of the invention is to provide a roof which will ensure a minimum consumption of electric power per unit product owing to an optimized lining/cooled tube area ratio.

A further object of the invention is to cut down the number of bricklayers required for making a roof lining.

Said and other objects are achieved the provision of a cooled roof for an electric furnace, comprising a roof ring having a passageway for a flow of coolant to pass therethrough, with a tubular framework fitted with fixtures for supporting a refractory lining resting on said roof ring, wherein, according to the invention, resting on said roof ring are beams-headers comprised in said roof, with loop-shaped framework tubes being coupled with, suspended from and running transversely to said beams-headers, said framework tubes being fixed at one end on the roof ring and carrying on their top reneratrices metal straps attached thereto and acting as the fixtures for supporting said refractory lining comprising at least one layer of bricks placed in rows, with each brick resting with its end portions on the adjacent framework tubes and being arranged with a clearance relative to said metal straps, said clearance being sufficient to enable brick expansion when heated.

More extended service life of the proposed roof is enabled by that the refractory brick used for the roof lining are placed freely on the cooled tubes with a clearance between said brick and metal straps without resorting to any mortar whatsoever, i.e. in service each refractory brick is capable to expanding freely in any direction, which makes up for thermal stresses arising in the refractory brickwork, eliminating thereby a major kind of wear of the roof lining in electric furnaces, i.e. cracking and spalling of refractories.

The herein-proposed cooled roof construction does not involve any additional appliances for binding the refractory brick to the cooled tubes, each brick being placed freely thereon, which cuts down both the time and labour inputs in erecting a roof lining.

Moreover, with the proposed constructional arrangement of the roof lining it is possible to remove any worn-out brick therefrom to be replaced by a new one directly on the furnace, i.e. without removing the furnace roof.

By increasing the pitch between the cooled tubes in the roof framework, the number of said tubes can be diminished materially as against the prior-art tubular cooled roof or, in other words, the area of a cooled surface would be reduced substantially as compared with box-type cooled roofs, with the resultant appreciable decrease in power requirements per unit product.

DESCRIPTION OF THE DRAWINGS

The present invention will be better understood from a consideration of a detailed description of the exemplary embodiment of a cooled roof for an electric furnace to be had in conjunction with the accompanying drawings, in which:

Referring now to FIGS. 1 through 3, there is shown therein an electric furnace roof which comprises parallel tubes 1 resting with their end portions on a hollow roof ring 2. In the central part, said tubes 1 are suspended at two points from hollow headers-beams 3 and 4, as shown in FIG. 2, of which the bottom header-beam 3 is adapted for supplying and the top header-beam 4 for draining a coolant. The tubes 1 are suspended from the headers-beams by way of hangers such as shown at 5 in FIG. 1. Said tubes 1 of the cooled furnace roof are coupled with the header-beam 3, such as shown in FIG. 2, through pipe connections 6 and with the header-beam 4, through pipe connections 7. The headers-beams 3 and 4 are welded in pairs to each other, a plate 8 being placed therebetween to provide better attachment of said headers-beams.

The tubes 1 are loop-shaped and are running transversely to said headers-beams 3 and 4 forming therewith a roof framework with fixtures for supporting the refractory lining of said furnace roof.

Figure 2:
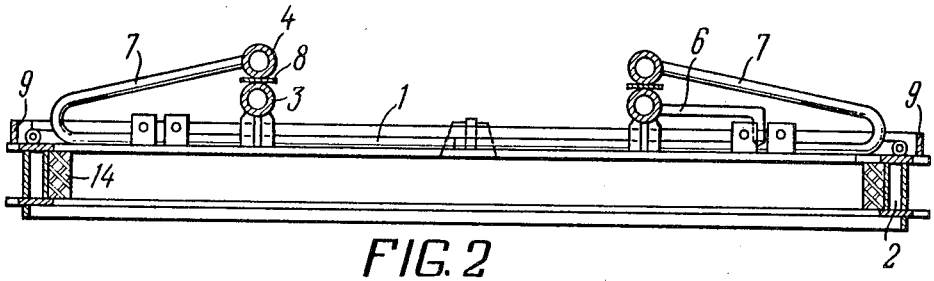
FIG. 2 is a cross-section II—II of FIG. 1.
Figure 3:
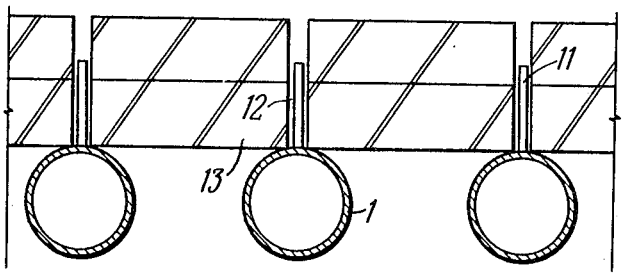
FIG. 3 is a cross-section III—III of FIG. 1.

For assuring proper gas-tightness, a shell 9 is welded round the circumference of the roof ring 2. Each bend of the tube 1 is attached to the roof ring 2 by clips 10. A metal strap such as shown at 11 in FIG. 3, is welded along the top generatrix of each tube 1 and acts as a fixture for supporting said refractory lining. The adjacent metal straps 11 are separated by brick 13 placed therebetween with a clearance 12 and resting with their end portions on the adjoining tubes 1. The refractory brick 13, acting as a refractory lining, are placed on the tubes 1 at least in one layer. The side wall of the roof ring 2 (FIG. 2) facing the furnace interior, is protected with a refractory material 14. For suspending the roof, provision is made for lugs 15 (FIG. 1), and for handling it there are hooks 16. To enable the passage of electrodes 17 through the roof, the latter is fitted with appropriate holes (not shown in the drawing).

The herein-proposed roof for an electric furnace operates in the following manner.

Figure 1:
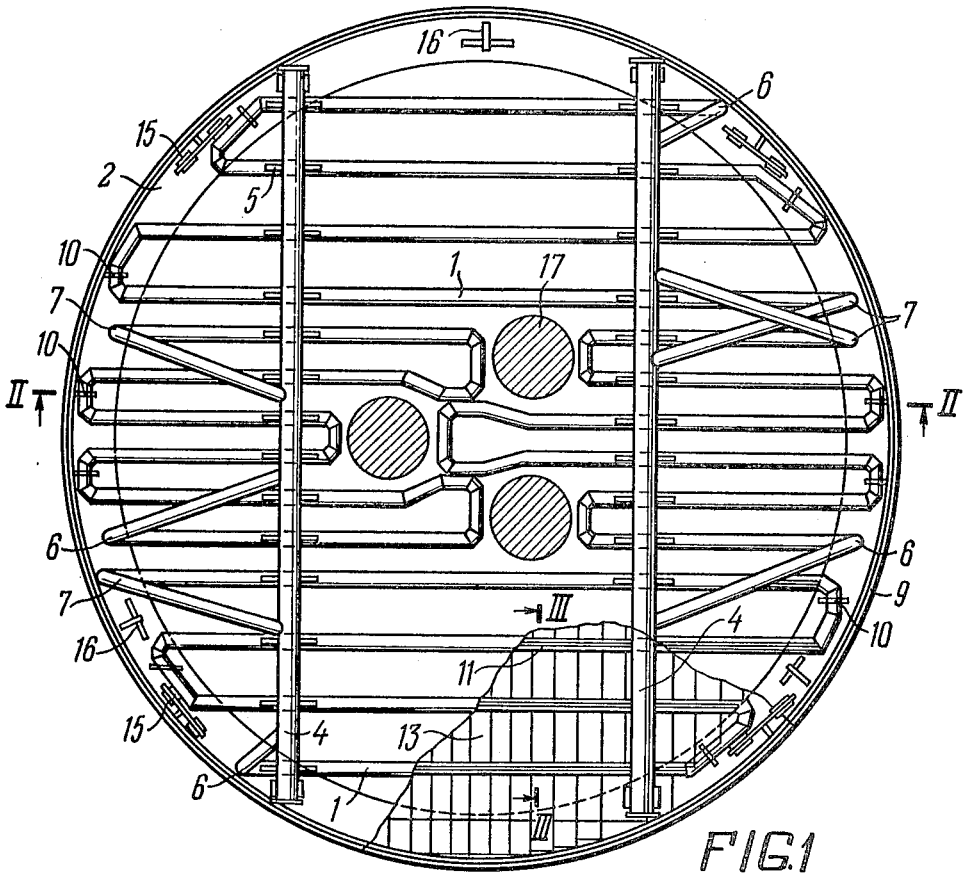
FIG. 1 is a plan view, partly broken out, of a cooled roof for an electric furnace.

As shown in FIG. 1, the roof is suspended by means of the hooks 16 and relevant hoisting means and placed on the furnace to be secured thereto by way of the lugs 15. A system of pipelines (hoses and pipings) is adapted for supplying the coolant into the headers-beams 3, said coolant flowing through the pipe connections 6 into the cooled tubes 1 and through the pipe connections 7 into the top header-beam 4, wherefrom it is drained into a discharge funnel. The refractory brick 13 and placed on the cooled tubes 1 so that even is case of their maximum expansion during furnace firing the clearance 12 is retained between the strap 11 and said refractory brick 13. After a number of heats slag-metallic deposits, formed on the entire bottom surface of the tubes 1 and brick 13, preclude the outflow of the heat products through the leaks in the furnace roof and cut down heat looses by protecting the cooled tubes 1.

The proposed roof is characterized by an extremely slow wear of its refractories, since the major kind of said wear in electric furnace roofs, cracking and spalling, is avoided. Moreover, it allows utilizing actually the entire thickness of the refractory roof arch; a worn brick can be easily replaced in any roof section without stripping the furnace roof.

The proposed design of the cooled roof was tested on a 60 t electric-arc furnace and the experiments had fully demonstrated both the reliability and technological effectiveness of the proposed embodiment. Lining thickness was 150 mm which was half as great as that in the prior-art roofs. As for the period of life of the cooled roof, it increased 2.5 times and amounted to 244 heats.

Excessive consumption of electric energy was from 1 to 15% of the power requirement per unit product when using an uncooled roof. Moreover, the life period of wall brickwork was also extended to 244 heats, whereas commonly the brickwork withstood only 160 heats. This close agreement between the periods of life of the roofs and walls of electric-arc furnaces offers a reduction in the number of repairs, since there is no need whatsoever to stop the furnace firstly for repairing its walls and then for replacing its roof.

The present invention offers solution to the problem of extending service life of roofs for electric steel-making furnaces, the effect of said invention being still greater as the proposed cooled roof adapted for electric furnaces not only features an extended period of life but is characterized by minimum heat looses, an increase in power requirements being thereby almost negligible indistinction to furnace roofs not employing any cooling systems whatsoever; if compared with similar prior-art cooled roofs the proposed one provides a considerable saving in power.

What we claim is:

1. A cooled roof for an electric furnace, comprising: a roof ring having a space for the passage of a coolant; beams-headers resting on said roof ring; a framework formed by loop-shaped tubes coupled with and running transversely to said beams-headers, from which they are suspended and fixed at one end on said roof ring; metal straps, of which each one is secured to the top generatrix of the tube of said framework; a refractory lining made up of bricks placed at least in one layer in rows so that in each row the brick are resting with their end parts on the adjacent tubes of said framework and are arranged with a clearance sufficient for their thermal expansion when heated between said metal straps welded edgewisely to the top generatrices of said framework tubes.

* * * * *